US005141451A

United States Patent [19]

Down

[11] Patent Number: 5,141,451

[45] Date of Patent: Aug. 25, 1992

[54] SECUREMENT MEANS FOR COAXIAL CABLE CONNECTOR

[75] Inventor: William J. Down, Phoenix, Ariz.

[73] Assignee: Gilbert Engineering Company, Inc., Glendale, Ariz.

[21] Appl. No.: 705,033

[22] Filed: May 22, 1991

[51] Int. Cl.[5] ..... H01R 17/04

[52] U.S. Cl. ..... 439/585; 439/882

[58] Field of Search ..... 439/578-585, 439/675, 877-882, 434, 444, 433

[56] References Cited

U.S. PATENT DOCUMENTS

| | | | |
|---|---|---|---|
| 3,196,382 | 7/1965 | Morello, Jr. | 439/585 |
| 3,355,698 | 11/1967 | Keller | 439/882 |
| 4,400,050 | 8/1983 | Hayward | 339/177 |
| 4,684,201 | 8/1987 | Hutter | 439/585 |
| 4,755,152 | 7/1988 | Elliot et al. | 439/585 |
| 4,990,106 | 2/1991 | Szegda | 439/585 |

FOREIGN PATENT DOCUMENTS

| | | |
|---|---|---|
| 1465137 | 2/1969 | Fed. Rep. of Germany . |
| 479169 | 9/1969 | Switzerland . |

*Primary Examiner*—David L. Pirlot

*Attorney, Agent, or Firm*—Don J. Flickinger; Jordan M. Meschkow; Lowell W. Gresham

[57] ABSTRACT

A connector for securing the end of a coaxial cable to a selected device in a cable transmission system includes an inner tubular member and a coaxial outer tubular member. The inner tubular member is receivable between the dielectric and the outer conductor of the cable. The outer tubular member, includes a sidewall having a medial thickness which is different than the thickness of either end and a bore for receiving any in a series of cables having differing diameters. In response to a pre-determined inward deformation of the sidewall of the outer tubular member, and outer conductor and the jacket of any cable selected from the series is gripped between the inner and outer tubular members.

6 Claims, 3 Drawing Sheets

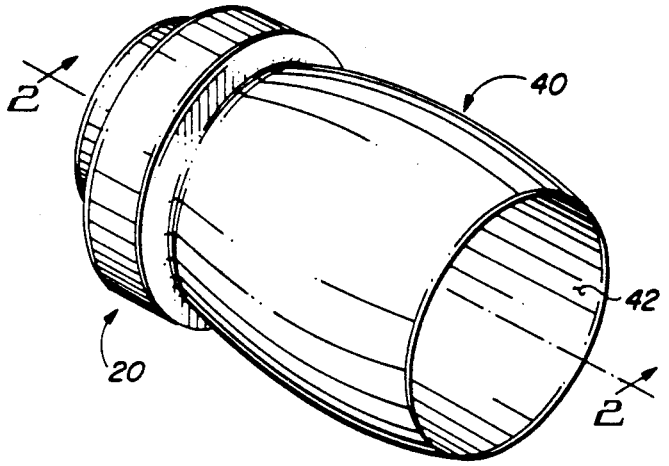
FIG. 1
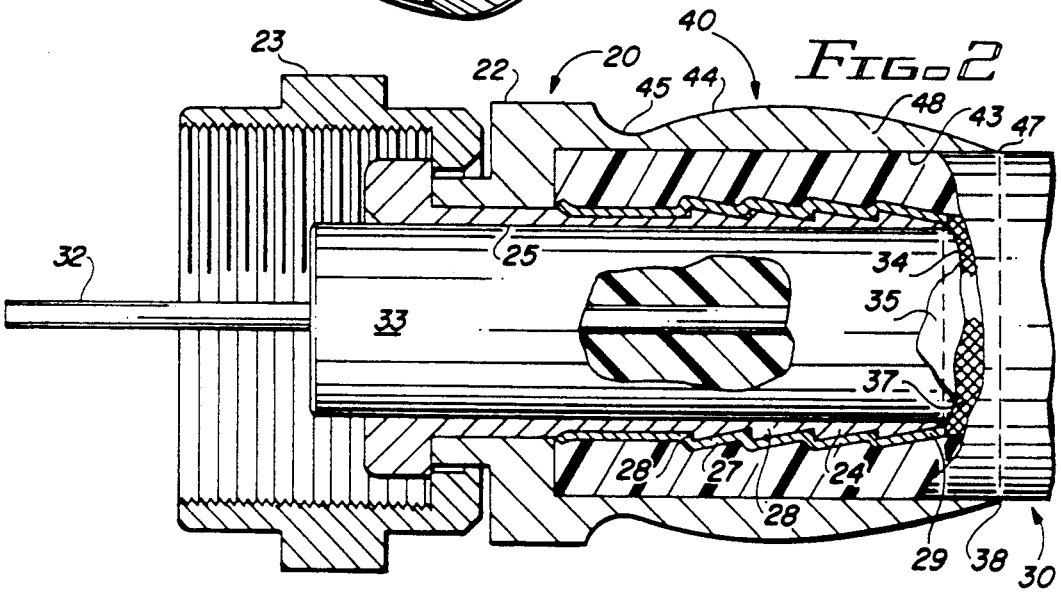
FIG. 2
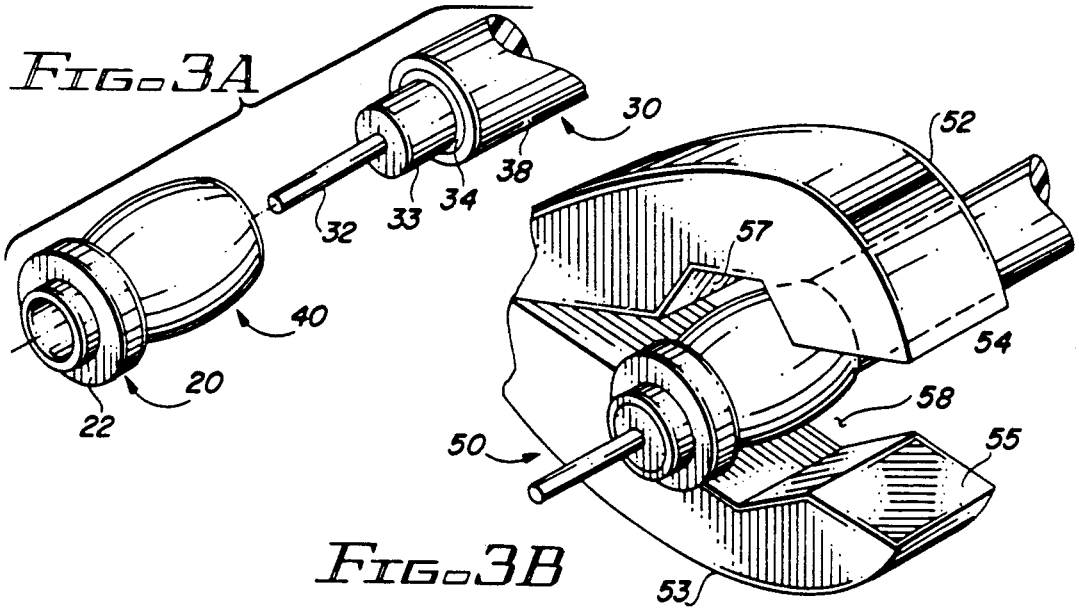
FIG. 3A
FIG. 3B

SECUREMENT MEANS FOR COAXIAL CABLE CONNECTOR

BACKGROUND OF THE INVENTION

This invention relates to cable transmission systems.

More particularly, the present invention relates to connectors of the type normally used to connect coaxial cable to devices within a cable transmission system.

In a further and more specific aspect, the instant invention concerns improvements for securing a connector to a coaxial cable.

PRIOR ART

Cable transmission systems for the transfer of signals between devices are well known. Exemplary systems are cable antenna television (CATV) and local area networks (LAN). Generally included are remotely located primary devices such as a central computer and terminals in a LAN system, or an antenna and receiver sets in a CATV system. Intermediate the primary devices, the typical system may also include various auxiliary devices, such as couplers, directional taps and amplifiers.

Coaxial cable provides signal communication among the several devices in a system. Commercially available coaxial cable includes a center conductor and an outer conductor separated and insulated by a dielectric and encased in a protective jacket. The conductive elements are commonly fabricated of metal, such as copper or aluminum. Polyethylene and polyvinyl chloride (PVC) are usual materials for the nonconductive components.

Characteristically, the center conductor is a solid wire which is coaxially carried within the cylindrical dielectric. The outer conductor includes two elements, a foil sheath encasing the dielectric and a pliant wire braid woven about the foil sheath. The tubular protective jacket snugly embraces the wire braid.

Numerous connectors are used throughout a typical cable transmission system. A connector, for example, is interposed between each of the several devices and the respective cable. One end of a connector is mechanically and electrically securable to the cable end, while the other end is especially adapted for attachment to the device.

Conventional means for securing the cable includes a pair of coaxial tubular members extending from the body of the connector. The outer tubular member is a relatively thin walled structure of uniform thickness defined by inside and outside surfaces which are sections of concentric right cylinders. The inner tubular member is similarly structured. Gripping means, such as annular ridges, are usually formed on the outside surface of the inner tubular member. Gripping means on the inside surface of the outer tubular member is also known.

During assembly, the end of the cable is inserted into the outer tubular member while simultaneously the inner tubular member is forced between the dielectric and the outer conductor. Subsequently, the outer tubular member is compressed, captivating the jacket and the outer conductor between the tubular members and embedding the gripping means into the adjacent portion of the cable. The compression is accomplished by a manually operated device, known as a crimp tool, to deform the outer tubular member to a predetermined configuration and measurement.

Coaxial cable is commercially available in various nominal sizes or series, each embracing several specific outside diameters. Series RG 59, for example, includes four cables having outside diameters ranging from two hundred thirty eight one-thousandths of an inch (0.238") to two hundred sixty two one-thousandths of an inch (0.262"). The variance is due to the number of foil sheaths, the number of layers of braid and the density of the braid.

To insure proper securement between the cable and the connector, usually forty pounds minimum tensile strength, the prior art has resorted to an elaborate scheme. The scheme requires that each connector be available with numerous outer tubular members in an assortment of specific sizes to closely receive a respective cable of particular diameter. Since each tubular member must be compressed in accordance with predetermined standards it is necessary that crimp tools be equally as numerous.

The elaborate prior art schemes has placed an undue burden upon all concerned. Each of the myriad of commonly recognizable connectors must be manufactured with numerous alternate outer tubular members. The manufacturer must also provide a crimp tool for each outer tubular member. Correspondingly, suppliers and installers are encumbered with ponderous inventory. Ultimately, the resulting financial burden is borne by the consumer.

SUMMARY OF THE INVENTION

It would be highly advantageous, therefore, to remedy the foregoing and other deficiencies inherent in the prior art.

Accordingly, it is an object of the present art to provide improvements in connectors of the type especially adapted for use in cable transmission systems.

Another object of the invention is the provision of improved means for securing a connector to a coaxial cable.

And another object of this invention is to provide improved securement means that can be integrally incorporated into standard prior art connector configurations.

Yet another object of the invention is the provision of securement means that can accommodate more than one specific size of cable.

Still another object of the immediate invention is to provide securement means that can be affixed to more than one size of cable with a single crimp tool.

Yet still a further object of the invention is the provision of improved means for controlling the force required to compress and affix a single securement means.

And a further object of the instant invention is to provide means for materially reducing the time and cost associated with the installation of a cable transmission system.

Still a further object of the invention is the provision of improvements which can be practiced with techniques and equipment considered standard in the art.

Yet a further object of the invention is to provide improvements which may assume alternate forms at the option of the manufacturer.

And yet a further object of the invention is the provision of improvements in securement means, according to the above, which are exceedingly simple and unencumbered while being highly effective.

Briefly, to achieve the desired objects of the instant invention in accordance with a preferred embodiment thereof, provided are inner and outer tubular members which coaxially project from the body of a connector. The tubular members are alternately securable to at least a first cable and a second cable having different predetermined outside diameters. The outer tubular member, which is fabricated or deformable material, includes a bore and an external surface which define a sidewall having a pair of spaced apart ends and a medial portion of greater thickness than the thickness of either end. The bore is sized to alternately receive either cable therein. The inner tubular member is receivable between the dielectric and the outer connector of either cable. The outer conductor and the jacket of either cable is gripped between the inner tubular member and the outer tubular member in response to a predetermined inward deformation of the sidewall of the outer tubular member.

In accordance with a further embodiment of the invention, the bore of the outer tubular member includes a cylindrical surface of substantially uniform diameter which is sized to closely receive the cable having the larger diameter. The external surface of the outer tubular member is outwardly projecting. Preferably, the surface is uniformly arcuate. Further provided are means for controllably varying the resistance of the sidewall of the outer tubular member to the inward deformation. More specifically, the means for controllably varying the resistance may be include at least one annular groove of predetermined cross sectional area formed into the external surface of the outer tubular member. At least a second annular groove may also be formed into the outer tubular member at a predetermined longitudinal interval from the one annular groove.

BRIEF DESCRIPTION OF THE DRAWINGS

The foregoing and further and more specific objects and advantages of the instant invention will become readily apparent to those skilled in the art from the following detailed description of the best modes of practicing same taken in conjunction with the drawings, in which:

FIG. 1 is a perspective view of a component of a conventional prior art cable connector as it would appear in combination with improved cable securement means constructed in accordance with the teachings of the instant invention;

FIG. 2 is vertical sectional view taken along the line 2—2 of FIG. 1 and showing the embodiment thereof as it would appear when initially coupled with a cable;

FIG. 3A is a perspective view of the embodiment of FIG. 1 and the end of a conventional coaxial cable prepared for coupling therewith;

FIG. 3B is a perspective view of the coupled cable and connector seen in FIG. 3A as it would appear when first inserted into a crimp tool;

DESCRIPTION OF THE PREFERRED EMBODIMENT

Figure 3C:
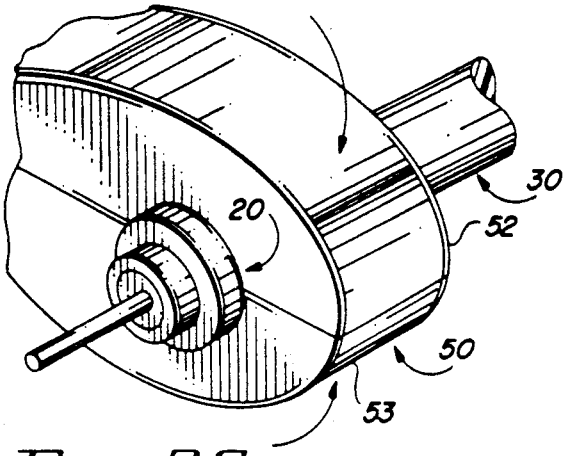
FIG. 3C is a view generally corresponding to the view of FIG. 3B and illustrating the terminal step of securing the improved securement means of the instant invention to the cable.

Turning now to the drawings in which like reference numerals indicate corresponding elements throughout the several views, attention is first directed to FIGS. 1 and 2 which illustrate a cable connector generally designated by the reference character 20 incorporating improved cable securement means embodying the teachings of the instant invention. In accordance with the conventional prior art, connector 20 includes an electrically conductive body 22 usually fabricated of a metal such as brass or aluminum. A nut 23, rotatably carried by body 22, functions as connection means for detachable union with a selected device within a cable transmission system. An elongate tubular member 24, having axially extending bore 25 and coaxial cylindrical outer surface 27, extends from body 22 in a direction opposite nut 23. Commonly, inner tubular member 24 is provided with gripping means such as annular ridges 28 formed into outer surface 27. Inner tubular member 24 terminates with free end 29.

With further reference to FIG. 2, there is seen a conventional prior art coaxial cable, generally designated by the reference character 30, including a center conductor 32 encased in a cylindrical dielectric 33. An outer conductor 34, typically including an inner foil sheath and an outer braid of woven pliant wire, encircles dielectric 33. A jacket 38 encircles outer conductor 34 and functions as the outer protective component.

The conductive elements, center conductor 32 and outer conductor 34, are commonly fabricated of metal such as copper or aluminum. Polyethylene and polyvinyl chloride (PVC), are usual materials for the non-conductive components, dielectric 33 and jacket 38. Typically, the outer conductor 34 may include one or more foil sheaths 35 and one or more layer of braid 37. Further, the density of the braid is subject to variation. Accordingly, the outside diameter of cable 30 is subject to variation. In series RG 59 cable, for example, the variation is twenty four one-thousandths of an inch between a minimum diameter of two hundred thirty eight one-thousandths of an inch and a maximum diameter of two hundred sixty two one-thousandths of an inch.

The foregoing description of cable 30 and of the prior art components of connector 20 are set forth herein for purposes of orientation and reference in connection with the ensuing detailed description of the improved cable securement means of the instant invention. Further and more specific details not described nor illustrated will be readily appreciated by those skilled in the art.

Provided by the instant invention is an elongate outer tubular member, generally designated by the reference character 40, which is preferably integrally fabricated with body 22 to extend coaxial with inner tubular member 24. Outer tubular member 40 includes bore 42 having internal surface 43 and exterior surface 44. Longitudinally, outer tubular member 40 extends between an inner end 45 at the juncture with body 22 and a free end 47. External surface 44 and internal surface 43 define sidewall 48 of tubular member 40 lying between ends 45 and 47.

In accordance with the immediately preferred embodiment of the instant invention, surface 43 is cylindrical and of a substantially uniform diameter. External surface 44 is outwardly projecting, preferably uniformly arcuate. Accordingly, it is seen that surfaces 43 and 44 define a sidewall having a medial portion of greater thickness than the thickness of either end. Bore 42 is sized to receive the cable having the largest specific diameter of a given series. The difference in thickness between the medial portion of sidewall 48 and either end thereof generally corresponds to one-half of the difference between the diameters of the largest and the smallest cables within a given series.

The securement of connector 20 incorporating the previously described embodiment of the instant invention with cable 30 is generally analogous to the corresponding prior art procedure. With reference to FIG. 3A, it is seen that the end of cable 30 is prepared in accordance with the teachings of the prior art. Connector 20 is then joined with cable 30 during which cable 30 is received within bore 42 of outer tubular member 40 and inner tubular member 24 being received between dielectric 33 and outer conductor 34 as seen with reference to FIGS. 2 and 3B.

Figure 4:
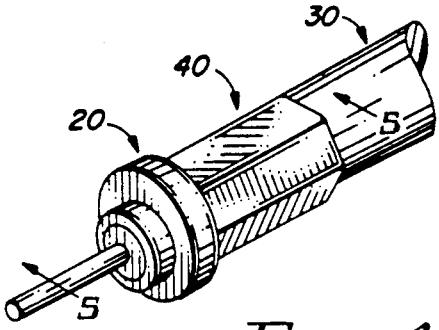
FIG. 4 is a perspective view illustrating the improved securement means after being secured to the end of the cable.
Figure 5:
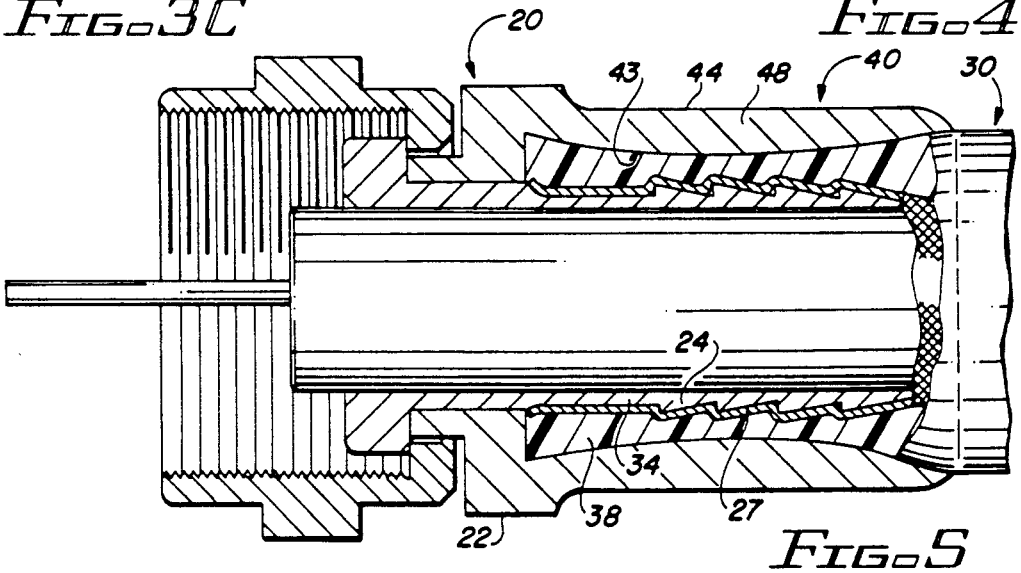
FIG. 5 is an enlarged vertical sectional view taken along the line 5—5 of FIG. 4.

Further seen in FIG. 3B is a conventional prior art crimp tool generally designated by the reference character 50 and having hingedly affixed jaws 52 and 53. Abutment surfaces 54 and 55 carried by the jaws 52 and 53, respectively, limit the contraction of jaws 52 and 53. Complemental halves 57 and 58 of a crimp cavity are formed into the jaws 52 and 53, respectively. When the jaws are closed, i.e. surface 54 is in contact with surface 55, the cavity formed by complemental halves 57 and 58 assumes a hexagonal cross section of predetermined dimension. In response to compression by crimp tool 50 as seen in FIG. 3C, outer tubular member 40 assumes the shape illustrated in FIG. 4. With further reference to FIG. 5, it is seen that sidewall 48 has been deformed inwardly with outer surface 44 assuming the shape and planer surfaces of the crimp cavity. A thickened medial portion of sidewall 48 is transferred to inner surface 43. Accordingly, compliant jacket 38 and outer conductor 34 are gripped between the outer surface 27 of inner tubular member 24 and the inner surface 43 of outer tubular member 40.

The prior art requires an outer tubular member of specific dimension for each different diameter of cable within a series. Each is then compressed within a corresponding crimp cavity. In a cable series including four specific diameters, four outer tubular members and several crimp cavities are necessary. Experimentation has shown that improved securement means of the instant invention in accordance with the foregoing description when compressed in the largest cavity for a specific series of cable will satisfactorily accommodate the difference in diameter and yield a satisfactory mechanical and electrical bond.

Figure 6:
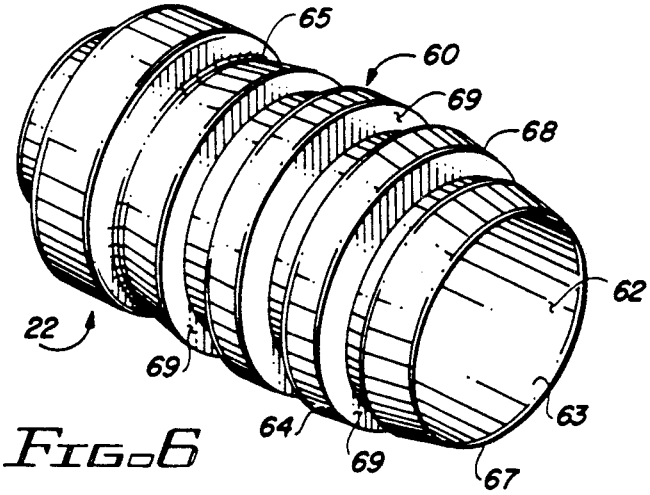
FIG. 6 is a perspective view of an alternate embodiment of the instant invention.

Reference is now made to FIG. 6 wherein there is seen an alternate embodiment of the instant invention including an outer tubular member generally designated by the reference character 60. Constructed in accordance with the teachings of the instant invention and in general similarity to previously described outer tubular member 40, outer tubular member 60 includes bore 62 having internal surface 63, external surface 64, inner end 65 and free end 67. Sidewall 68 is defined by internal surface 63 and external surface 64 lying between inner end 65 and free end 67. In further analogy to the previously described embodiment, it is preferred that internal surface 63 defines a cylinder of substantially uniform diameter and external surface 64 is outwardly projecting.

The thickness of the sidewall in accordance with the teachings of the instant invention is thicker than the sidewall of a conventional prior art outer tubular member. Accordingly, the sidewall exhibits greater resistance to compression thereby requiring somewhat greater force be applied to the crimp tool. In accordance with the immediate embodiment of the invention, regulating means are provided for controllably varying the resistance of the sidewall to inward deformation. In accordance with the immediately preferred embodiment of the invention, a plurality of annular grooves 69 are formed into sidewall 68 from external surface 64 at spaced longitudinal intervals. Each groove 69 is of a predetermined cross sectional area, i.e. selected width and depth. As will be appreciated by those skilled in the art, the resistance to deformation of outer tubular member 60 is directly related to the cross sectional area of each annular groove and the interval therebetween.

Figure 7:
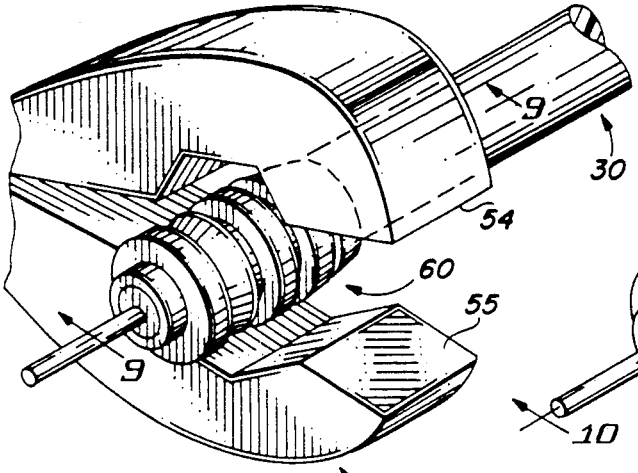
FIG. 7 is a perspective view of the embodiment of FIG. 6 as it would appear when coupled to the end of a coaxial cable in preparation for securement by a crimp tool.
Figure 9:
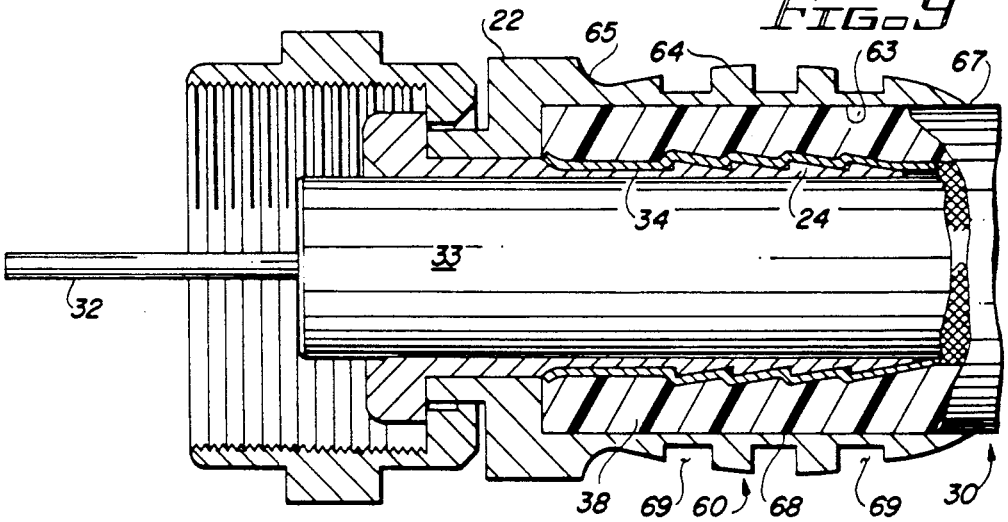
FIG. 9 is an enlarged vertical sectional view taken along the line 9—9 of FIG. 7.

The attachment of the immediate embodiment of the instant invention to coaxial cable 30 is analogous to the attachment of the embodiment designated by the reference character 40 and previously described in detail. It is noted that the immediate embodiment is similarly used in combination with inner tubular member 24. After preparation, as illustrated in FIG. 3A, cable 30 is inserted into outer tubular member 60 with inner tubular member 24 being received between dielectric 33 and outer conductor 34, as illustrated in FIGS. 7 and 9. The assembly is then placed into the crimp cavity of crimp tool 50 for compression which is limited by the contact of abutment surfaces 54 and 55.

Figure 8:
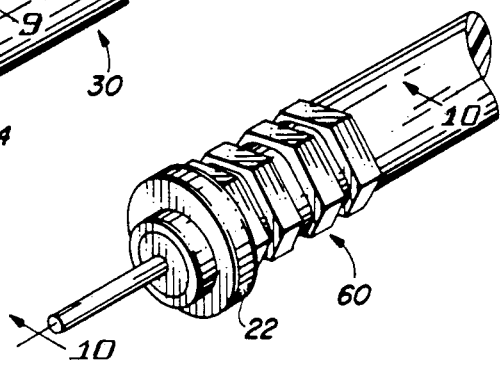
FIG. 8 is a perspective view illustrating the embodiment of FIG. 6 as it would appear after being secured to the cable.
Figure 10:
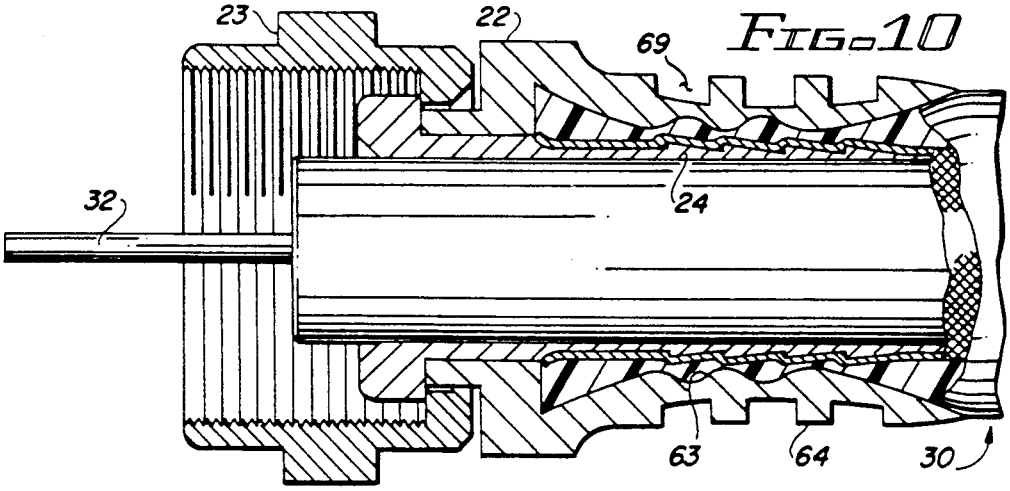
FIG. 10 is an enlarged vertical sectional view taken along the line 10—10 of FIG. 8.

Subsequent to the application of crimp tool 50, outer tubular member 60 is inwardly deformed to assume the shape illustrated in FIGS. 8 and 10. External surface 64 assumes the shape of the crimp cavity of tool 50 as previously described in connection with FIG. 4. Due to the presence of the grooves 69, however, an irregular contour is imparted to internal surface 63. Imperical observation has shown that the annular areas immediately adjacent the grooves 69 do not deform inwardly to the extent of the areas in between adjacent grooves 69. The annular irregularities of surface 63 serve to further strengthen the mechanical bond between outer tubular member 60 and coaxial cable 30.

Various changes and modifications to the embodiments herein chosen for purposes of illustration will readily occur to those skilled in the art. For example, while the internal surface of each outer tubular member has been illustrated and described as having a smooth cylindrical internal surface, it is apparent that the internal surface may be inwardly projecting analogous to the curvature of the external surface. The internal surface may also be provided with gripping members or teeth. Further exemplary is the fact that the annular grooves formed into the external surface of the one embodiment of the invention may assume other cross sectional configurations. It is also noted that the improvements can be practiced with conventional prior art connectors other than the specific type chosen for purposes of illustration. To the extent that such modifications and variations do not depart from the spirit of the invention, they are intended to be included within the scope of the following claims.

I claim:

1. In a connector for securing the end of a coaxial cable to a selected device, which connector includes:

a body, and connection means for attachment to said device, and which cable includes:

a center conductor, an outer conductor coaxial with said center conductor, a dielectric disposed between said conductors, and a sheath of compliant material encasing said outer conductor and having a pre-determined outside diameter, improvements therein whereby said connector is alternately securable to said cable and to at least a second cable having a predetermined outside diameter different from the outside diameter of the first said cable, said improvements comprising:

a) an elongate inner tubular member projecting from said body and receivable between said dielectric and said outer conductor; and b) an elongate deformable outer tubular member projecting from said body substantially coaxial with said inner tubular member and including:

a bore for alternately receiving either said cable therein, an internal surface having a substantially uniform diameter, an external surface substantially coaxial with said bore and uniformly arcuate along its length, said internal surface and said external surface defining a sidewall having a pair of spaced apart ends and a medial portion having a thickness greater than the thickness of either said end, whereby the outer conductor and the jacket of either said cable is gripped between said inner tubular member and said outer tubular member in response to a pre-determined inward deformation of the sidewall of said outer tubular member.

2. The improvements of claim 1, wherein said bore is sized to closely receive the said cable having the larger diameter.

3. The improvements of claim 1, wherein the ends and the medial portion of said sidewall have a difference in thickness which is generally equal to one-half of the difference between the diameter of said second cable and the diameter of the first said cable.

4. The improvements of claim 1, further including regulating means for controllably varying the resistance of said sidewall to said inward deformation.

5. The improvements of claim 4, wherein said regulating means includes at least one annular groove of predetermined cross sectional area formed into the external surface of said outer tubular member.

6. The improvements of claim 5, wherein said regulating means includes at least a second annular groove of predetermined cross sectional area formed into the external surface of said outer tubular member at a predetermined longitudinal interval from said one annular groove.

* * * * *